US007642987B2

(12) United States Patent
Newman

(10) Patent No.: US 7,642,987 B2
(45) Date of Patent: Jan. 5, 2010

(54) MONOPOLE TOWER SYSTEM

(76) Inventor: Jerry Newman, 17301 S. Kira Sue La., Spangle, WA (US) 99031

( * ) Notice: Subject to any disclaimer, the term of this patent is extended or adjusted under 35 U.S.C. 154(b) by 195 days.

(21) Appl. No.: 11/701,562

(22) Filed: Jan. 31, 2007

(65) Prior Publication Data

US 2008/0180349 A1 Jul. 31, 2008

(51) Int. Cl.
*H01Q 9/34* (2006.01)

(52) U.S. Cl. ..... 343/874

(58) Field of Classification Search ..... 343/874; 212/270, 179; 52/745.05

See application file for complete search history.

(56) References Cited

U.S. PATENT DOCUMENTS

| | | | | |
|---|---|---|---|---|
| 3,361,456 | A | 1/1968 | Durand | |
| 3,398,492 | A | 8/1968 | Nansel | |
| 4,899,832 | A * | 2/1990 | Bierscheid, Jr. | 173/187 |
| 5,537,125 | A | 7/1996 | Harrell, Jr. et al. | |
| 5,557,892 | A | 9/1996 | Lavin | |
| 5,980,190 | A * | 11/1999 | Takeda | 414/609 |
| 6,046,706 | A | 4/2000 | Vargas | |
| 6,189,712 | B1 | 2/2001 | Conrad et al. | |
| 6,266,955 | B1 * | 7/2001 | Liang et al. | 60/274 |
| 7,189,051 | B1 * | 3/2007 | Heifets | 415/4.2 |
| 2002/0139064 | A1 | 10/2002 | Norwood | |
| 2003/0025791 | A1 * | 2/2003 | Kaylor et al. | 348/143 |

FOREIGN PATENT DOCUMENTS

| | | |
|---|---|---|
| DE | 4441942 | 5/1996 |
| EP | 1 028 482 A2 | 8/2000 |
| GB | 1183181 | 3/1970 |

* cited by examiner

*Primary Examiner*—Huedung Mancuso
(74) *Attorney, Agent, or Firm*—Wells St. John P.S.

(57) ABSTRACT

A monopole tower system including nested or telescoping tower structures which may be erected utilizing hydraulic cylinders instead of cranes.

11 Claims, 19 Drawing Sheets

MONOPOLE TOWER SYSTEM

CROSS REFERENCE TO RELATED APPLICATION

This application does not claim priority from any other application.

TECHNICAL FIELD

This invention relates to what is generally referred to in the industry as a monopole tower system and a system for erecting it.

BACKGROUND OF THE INVENTION

As cell phones become more popular, the need for additional towers to carry cell phone antennas for transmitting and receiving calls has increased dramatically. As the population expands into different geographical areas and additional coverage is needed, there is an overwhelming need for additional permanent tower systems, including in some very remote and hard to get to areas. While these tower systems may be any one of a number of different heights, they are typically quite large and may extend to 150 feet or greater in height and are substantial in their structure. The prior art way of installing them is to move the towers in two or more (typically three) sections, which may be 50 feet in length. Once the sections are located at the installation site, a large crane must be utilized to stack and secure one tower structure upon another until the tower is erected. Cranes which span 150 feet or more are difficult to obtain for many installations, and if they can be obtained, they are quite expensive.

In a typical prior art system, one section, fifty feet long for example, is placed on top of another section and the bottom It is therefore an objective of this invention to provide a monopole tower system which does not require a crane to erect and secure.

It is also an objective of embodiments of this invention to provide a monopole tower erection system wherein a truck trailer configuration may be utilized to deliver and erect the tower system, and then reutilized for other system installations.

It is yet another objective of embodiments of this invention to provide a monopole tower system in which equipment utilized to erect the tower system need not span the entire length of the fully erected tower system.

While the invention was motivated in addressing some objectives, it is in no way so limited. The invention is only limited by the accompanying claims as literally worded, without interpretative or other limiting reference to the specification, and in accordance with the doctrine of equivalents.

Other objects, features, and advantages of this invention will appear from the specification, claims, and accompanying drawings which form a part hereof. In carrying out the objectives of this invention, it is to be understood that its essential features are susceptible to change in design and structural arrangement, with only one practical and preferred embodiment being illustrated in the accompanying drawings, as required.

BRIEF DESCRIPTION OF THE DRAWINGS

Preferred embodiments of the invention are described below with reference to the following accompanying drawings.

FIG. 16 is a front elevation partial view of the monopole tower system illustrated in FIG. 1, only wherein the monopole system is configured with an adapter to connect to other vehicles;

FIG. 17 is a front elevation partial view of the monopole tower system illustrated in FIG. 16, wherein the monopole system adapter is configured to operatively connect to an excavator;

FIG. 19 is a front elevation partial view of the monopole tower system illustrated in FIG. 16, wherein the monopole system adapter is configured to operatively connect to a log loader type of vehicle;

DETAILED DESCRIPTION OF THE PREFERRED EMBODIMENTS

Many of the fastening, connection, manufacturing and other means and components utilized in this invention are widely known and used in the field of the invention described, and their exact nature or type is not necessary for an understanding and use of the invention by a person skilled in the art or science; therefore, they will not be discussed in significant detail. Furthermore, the various components shown or described herein for any specific application of this invention can be varied or altered as anticipated by this invention and the practice of a specific application or embodiment of any element may already be widely known or used in the art or by persons skilled in the art or science; therefore, each will not be discussed in significant detail.

The terms "a", "an", and "the" as used in the claims herein are used in conformance with long-standing claim drafting practice and not in a limiting way. Unless specifically set forth herein, the terms "a", "an", and "the" are not limited to one of such elements, but instead mean "at least one".

Figure 1:
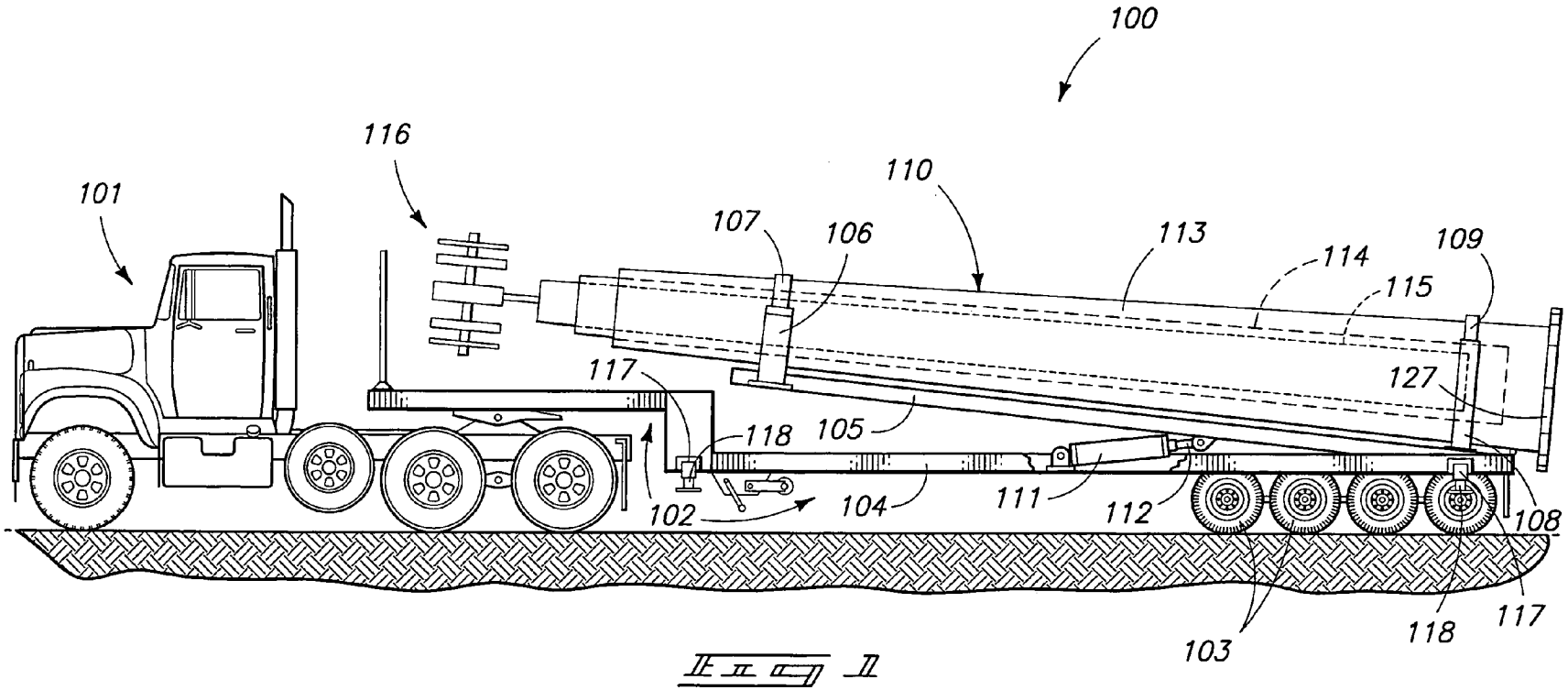
FIG. 1 is an elevation view of one embodiment of a monopole tower system contemplated by this invention.

FIG. 1 is an elevation view of one embodiment of a monopole tower system contemplated by this invention. FIG. 1 shows the towing vehicle 101, which may also be referred to as a tractor, and the trailer 102, with the trailer having the monopole tower system thereon. It will be appreciated by those of ordinary skill in the art, that the invention is not limited to a tractor and trailer separately, but instead may be any one of a number of different combinations, including one long truck. It will also be appreciated that it is preferable that the antenna 116, which is shown attached in FIG. 1, is transported separately and installed once the monopole tower 110 is in the vertical position and secured to its base. The monopole tower system 100, shown in FIG. 1, illustrates trailer framework 104, monopole support framework 105, hydraulic cylinder 111, with ram 112, which is operatively attached to monopole support framework 105 and to trailer framework 104. It is shown in later figures that the hydraulic cylinder 111 is mounted such that it pivots with respect to trailer framework 104 and is movably mounted such that its mount point moves horizontally to achieve the raising of the monopole tower 110 to a vertical position.

The monopole tower 110 in this embodiment of the invention is shown as three tower structures (which may also be referred to as tower sections), one within the other such that first tower structure 113 is the outer tower structure, second tower structure 114 fits within first tower structure 113 and may be moved relative thereto, and third tower structure 115 fits within second tower structure 114 and may be moved relative thereto, as more fully described and shown in other figures. First tower structure 113 includes tower base 127, which is attached to the bottom end of first tower structure 113, and which includes bolt apertures for receiving bolts that are implanted in the tower pad and which protrude therefrom, such that they go through the bolt apertures in tower base 127 and can be bolted to secure the monopole tower 110 to the ground in a vertical position.

Upper cradle 106 and lower cradle 108 are shown mounted to monopole support framework 105 to cradle, support, retain, and in some embodiments rotate, the monopole with respect to monopole support framework 105. Attached to upper cradle 106 is cradle strap 107, a retainer, which holds the monopole within upper cradle 106 while the monopole tower system 100 is being moved, and while the monopole 110 is being raised to a vertical position. Similarly, lower cradle 108 includes cradle strap 109, which may perform the same function as cradle strap 107.

In order to better stabilize the monopole tower system while the monopole 110 is being raised to a vertical position, and then raised vertically, are outriggers 117 and ground supports 118. As shown in later figures and described below, outriggers 117 may be extended laterally and then ground supports 118 lower to contact the ground to provided a leveling and/or a support function during the installation process. Trailer wheels 103 are shown operably attached to trailer 102 to provide ground support and movement for the trailer.

The configuration of the monopole tower system 100 shown in FIG. 1 shows the third tower structure 115 substantially nested within the internal cavity of the second tower structure 114, and the second tower structure 114 in turn substantially nested within the first tower structure 113. As can be seen, only a top portion of third tower structure 115 protrudes from the top of second tower structure 114, and only a top portion of second tower structure 114 protrudes from the top of first tower structure 113. This may also be referred to as a telescoping arrangement or configuration.

Figure 2:
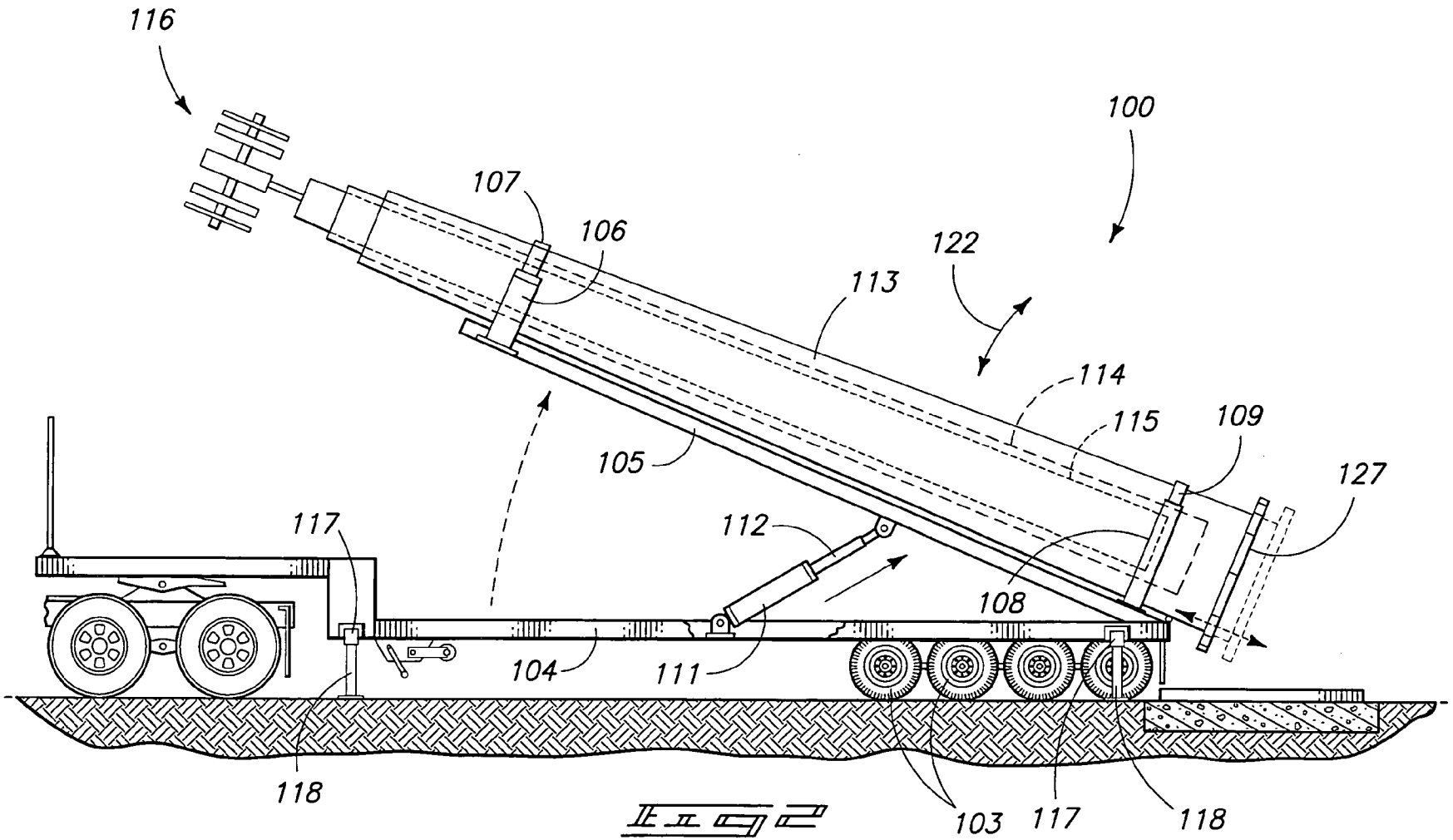
FIG. 2 is a front elevation partial view of the monopole tower system illustrated in FIG. 1, with the monopole partially rotated upward.

FIG. 2 is a front elevation partial view of the monopole tower system illustrated in FIG. 1, with the monopole partially rotated upward. FIG. 2 illustrates the same components as FIG. 1, only wherein the monopole support framework 105 has been partially raised by hydraulic cylinder 111 as indicated by arrow 122. Similarly numbered items in FIG. 2 are the same as those illustrated in FIG. 1, and will not be repeated herein.

Figure 3:
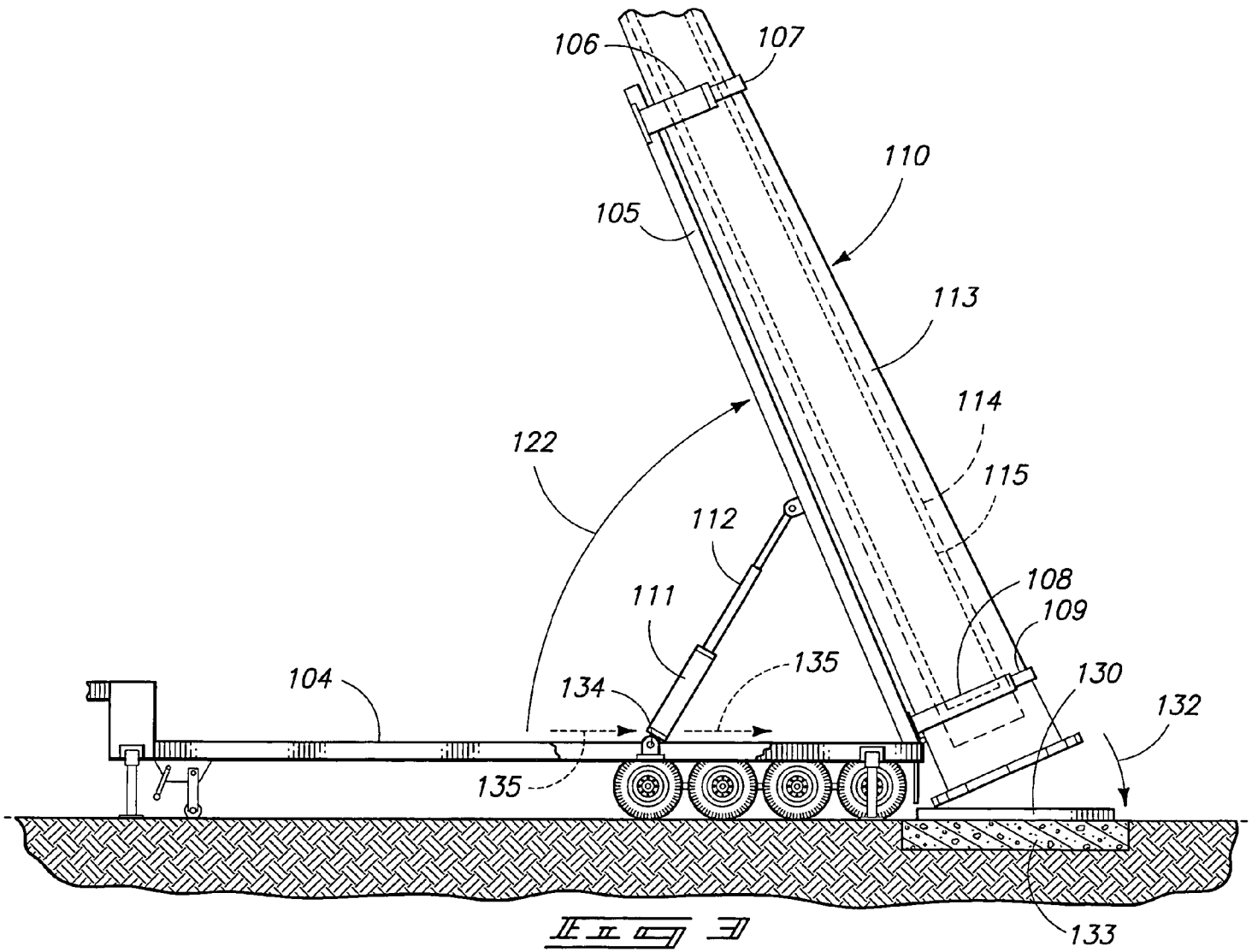
FIG. 3 is a front elevation view of the monopole tower system illustrated in FIG. 1, with the monopole further rotated towards its ultimate vertical position.

FIG. 3 is a front elevation view of the monopole tower system illustrated in FIG. 1, with the monopole further rotated towards its ultimate vertical position. FIG. 3 illustrates monopole tower 110 being further raised to the vertical position as indicated by arrow 122, by hydraulic cylinder 111 with ram 112. FIG. 3 also shows how in some embodiments of this invention, the hydraulic cylinder 111 may be operatively attached or connected to trailer framework 104 in a movable way such that it is mounted at mount 134 and moves as shown by arrows 135 as the monopole tower is further raised. Conversely, if the monopole tower ever needs to be lowered, such as during loading, the hydraulic cylinder mount 134 would move in the opposite direction of arrows 135 during the lowering process.

FIG. 3 further shows monopole support framework 105 with upper cradle 106 and lower cradle 108 mounted thereto and cradle strap 107 being connected to upper cradle 106 to secure the monopole tower 110 at the upper side and cradle strap 109 being attached to lower cradle 108 to secure the monopole tower 110 at the lower side. Arrow 132 shows how the direction of the tower being lowered as one end touches first and the tower is rotated about that end over the mount bolts to the base pad 130. The base pad 130 has underground support, or base 133, for additional support for the monopole tower once installed.

Figure 14:
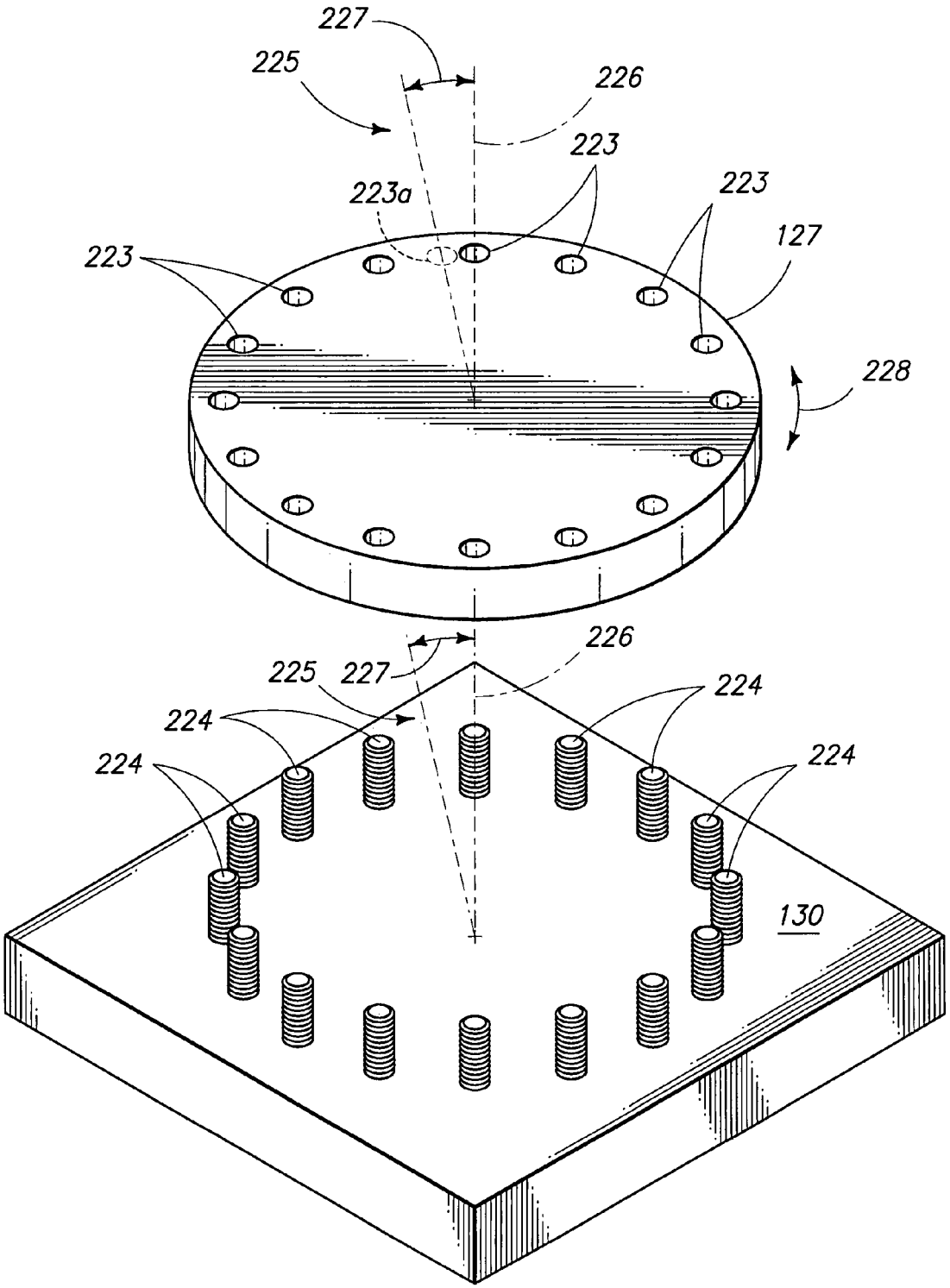
FIG. 14 is a partially schematic end view illustrating alignment issues requiring rotation of the monopole as it is being lowered to be secured to the base, with the bolt apertures needing to be lined up with the bolts protruding from the base.
Figure 15:
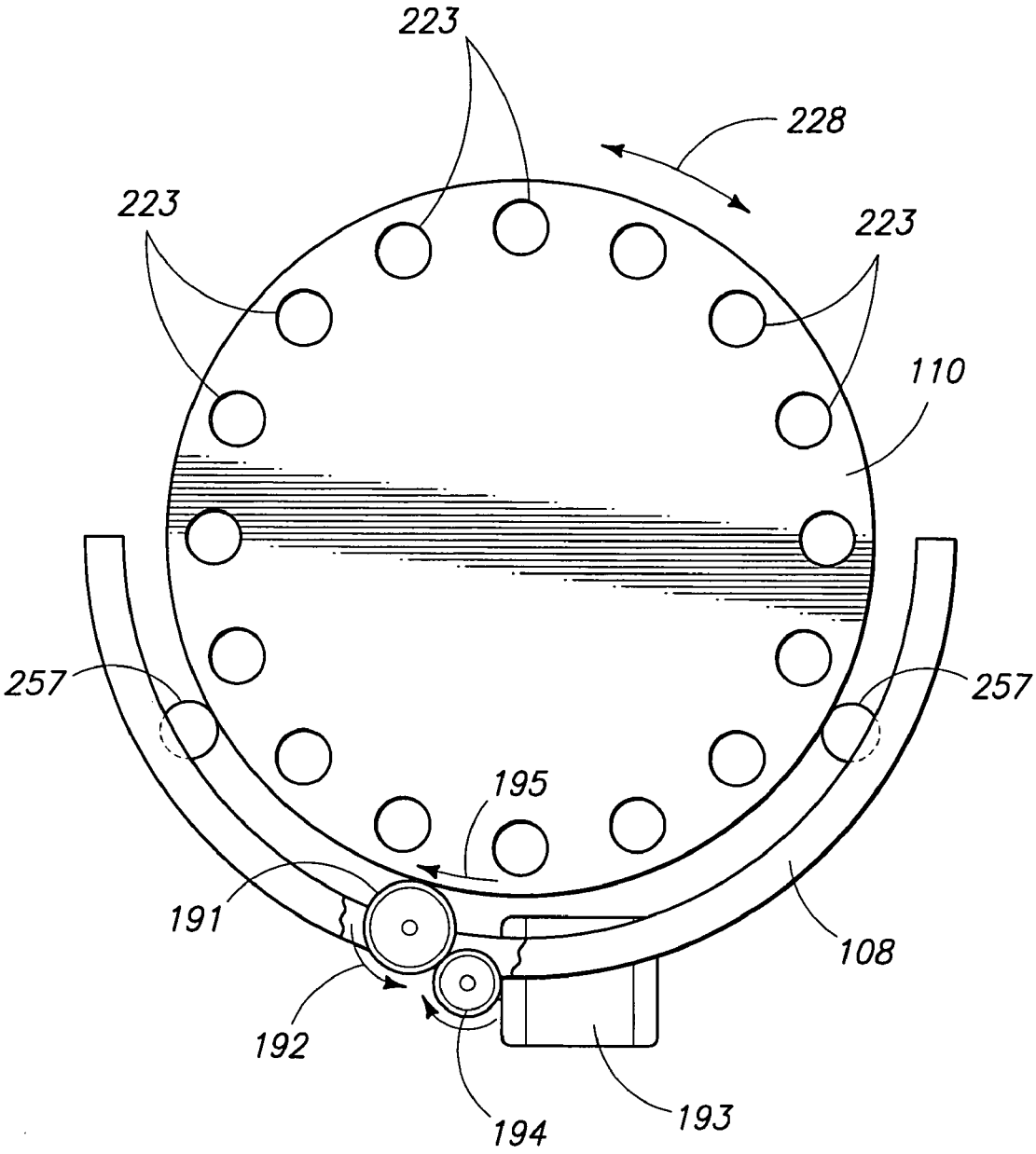
FIG. 15 is a cross-sectional end view of the first cradle and illustrates one embodiment of how the monopole might be rotated in order to align the bolt apertures in the monopole base with the bolts protruding from the support
Figure 11:
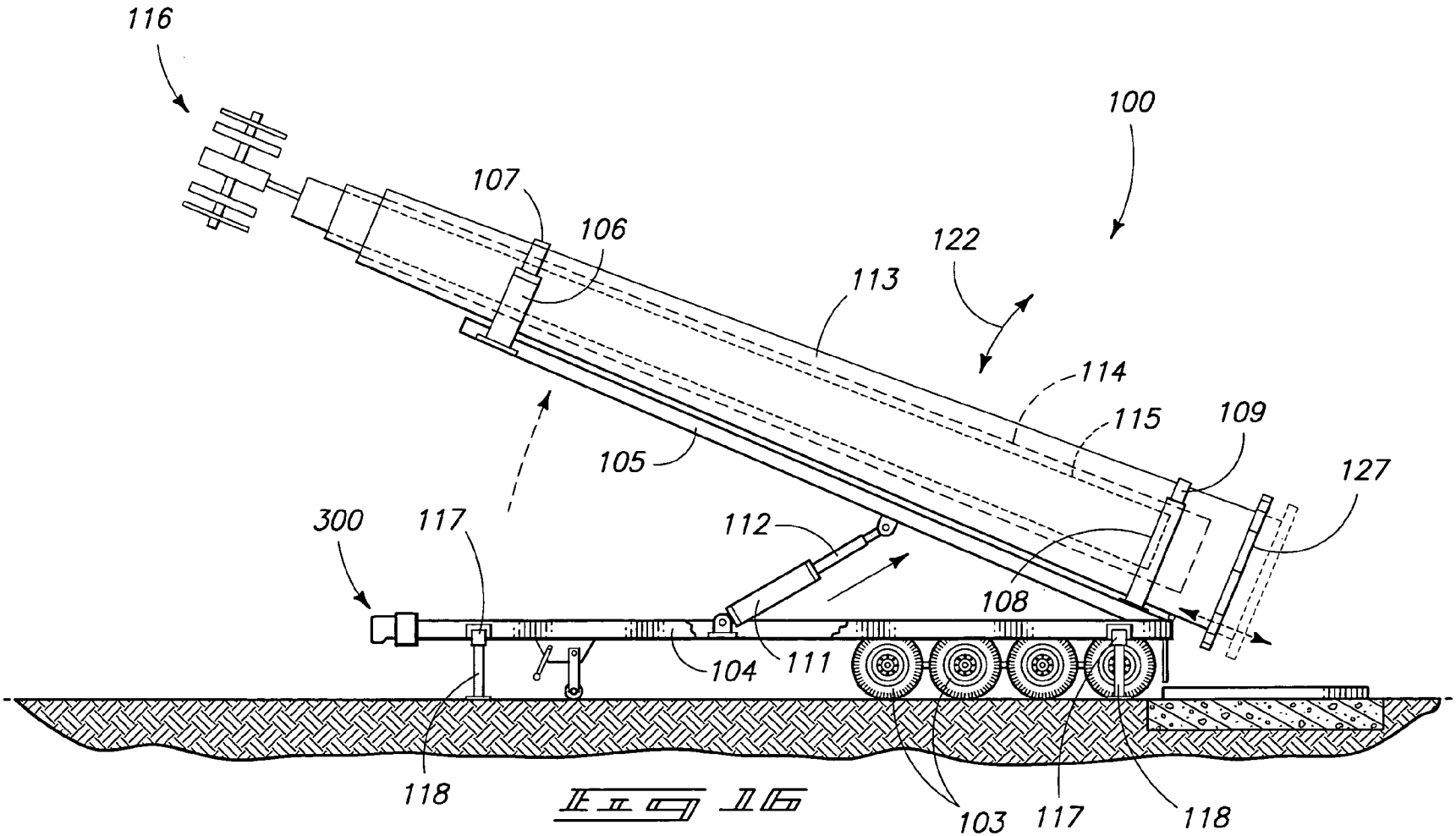
Figure 11:
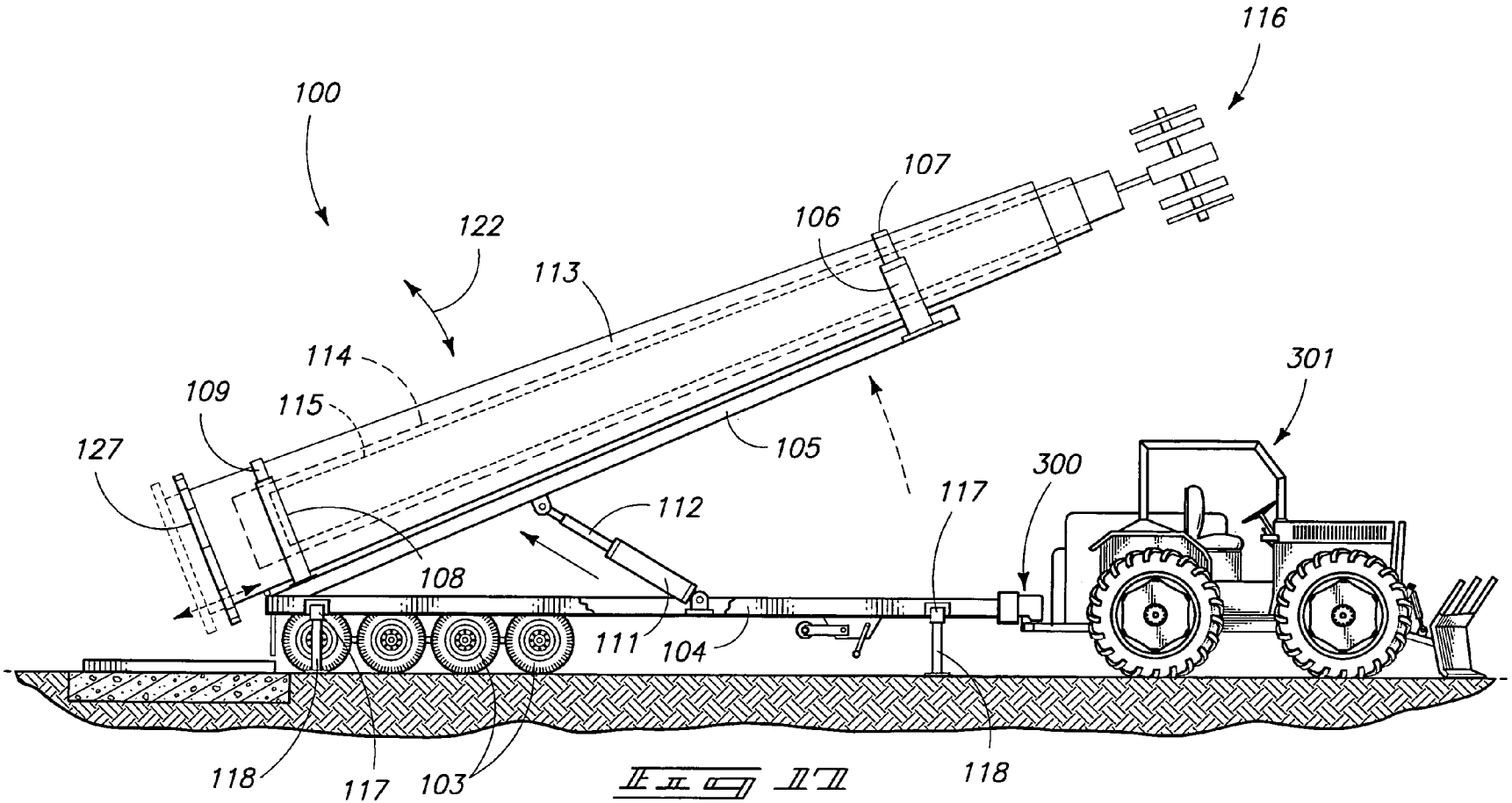

It will further be appreciated by those of ordinary skill in the art and those who install such monopole towers, that adjustments will need to be made in the relative angle of the monopole tower 110, with respect to the bolts, which are protruding from base pad 130. The bolts are not shown in FIG. 3, but are shown in FIG. 4, and an alignment process or method is also illustrated in FIGS. 14 and 15.

Figure 4:
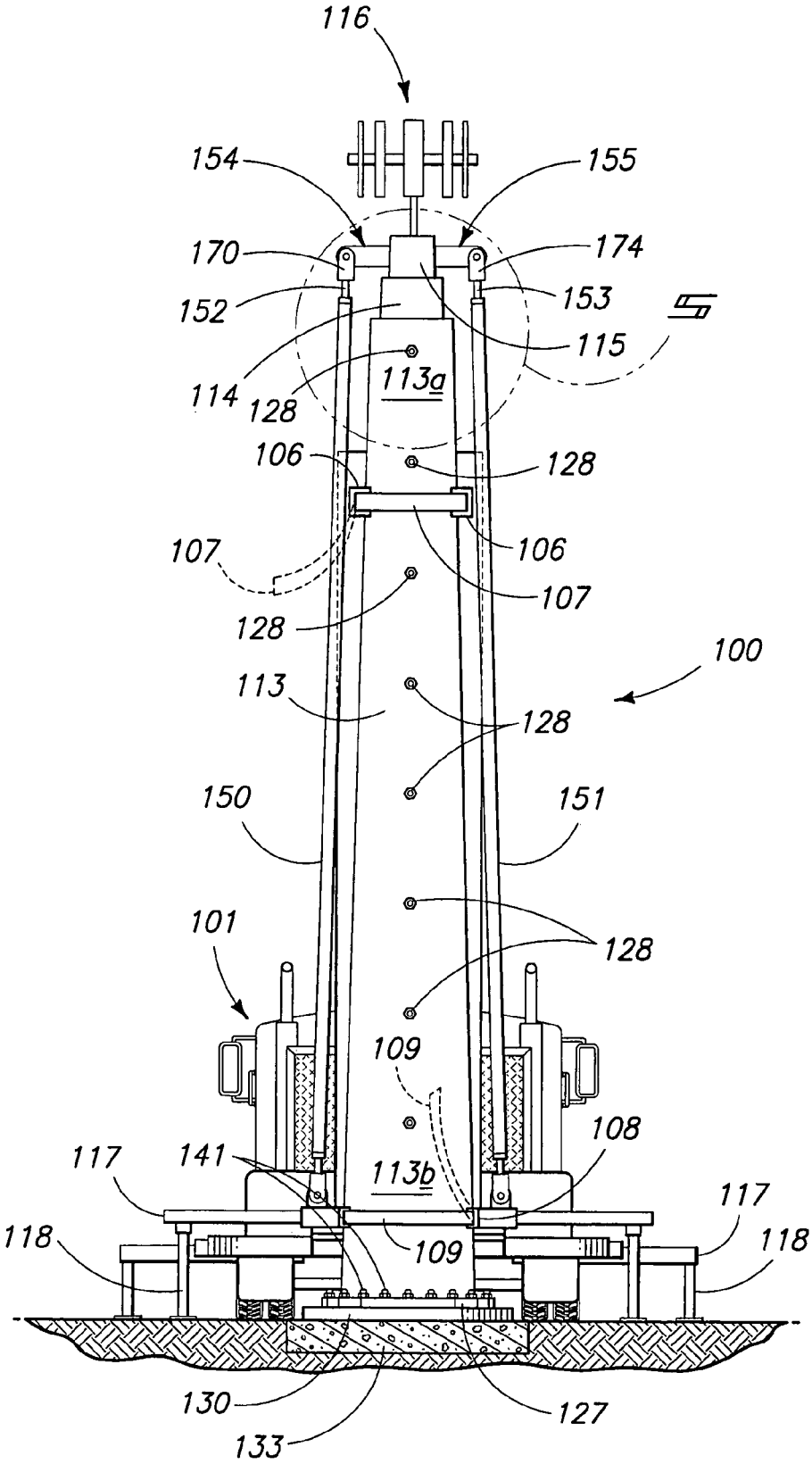
FIG. 4 is a side elevation view of the monopole tower system illustrated in FIG. 1, with the hydraulic lifters attached to the third tower structure.

FIG. 4 is a side elevation view of the monopole tower system illustrated in FIG. 1, with the hydraulic lifters attached to the third tower structure. FIG. 4 illustrates first tower structure 113 with upper end 113A and lower end 113B with the tower base 127 in place on the concrete base 130 and bolts 141 securing base 127 to the base pad 130. Once the monopole tower is in this position and still in its fully contracted state, the antenna 116 would typically be mounted to the third tower structure 115 before the tower structures are raised relative to one another. The cradle strap 107 have been removed at this point and upper cradle 106 is shown. Outriggers 117 and ground support 118 are shown in the extended position providing additional support and stability during the installation erection process.

Attached to the monopole support framework 105, are first hydraulic cylinder 150 with ram 152 and second hydraulic cylinder 151 with ram 153. The hydraulic cylinders 150 and 151 provide the lifting of tower support structures relative to one another in a sequence discussed below. Once the antenna and other work is done at the top of third tower structure 115, and the tower is ready to be raised, the hydraulic cylinders 150 and 151 are then operatively attached to the third tower structure 115 to raise it. One embodiment providing such a way of attaching is shown in FIG. 4, with ram connector 170 attaching to first connector 154, which becomes removably attached to third tower structure 115 and similarly, second ram attachment 174 is operably attached to connector 155, which is operably attached to the third tower structure 115. Once the attachments are secured, hydraulic cylinders 150 and 151 can provide the lift necessary to move third tower structure 115 relative to second tower structure 114 to its fully extended position. Once the third tower structure 115 is raised to its fully extended position relative to second tower structure 114, the two may be secured relative to one another while working at the height shown just above first tower structure 113 in FIG. 4. Once third tower structure 115 is secured relative to second tower structure 114, the hydraulic cylinder connectors 154 and 155 can be disconnected from third tower structure 115, retracted downward and then attached to connectors on second tower structure 114, with a similar process ensuing to raise second tower structure 114 relative to first tower structure 113.

Figure 5:
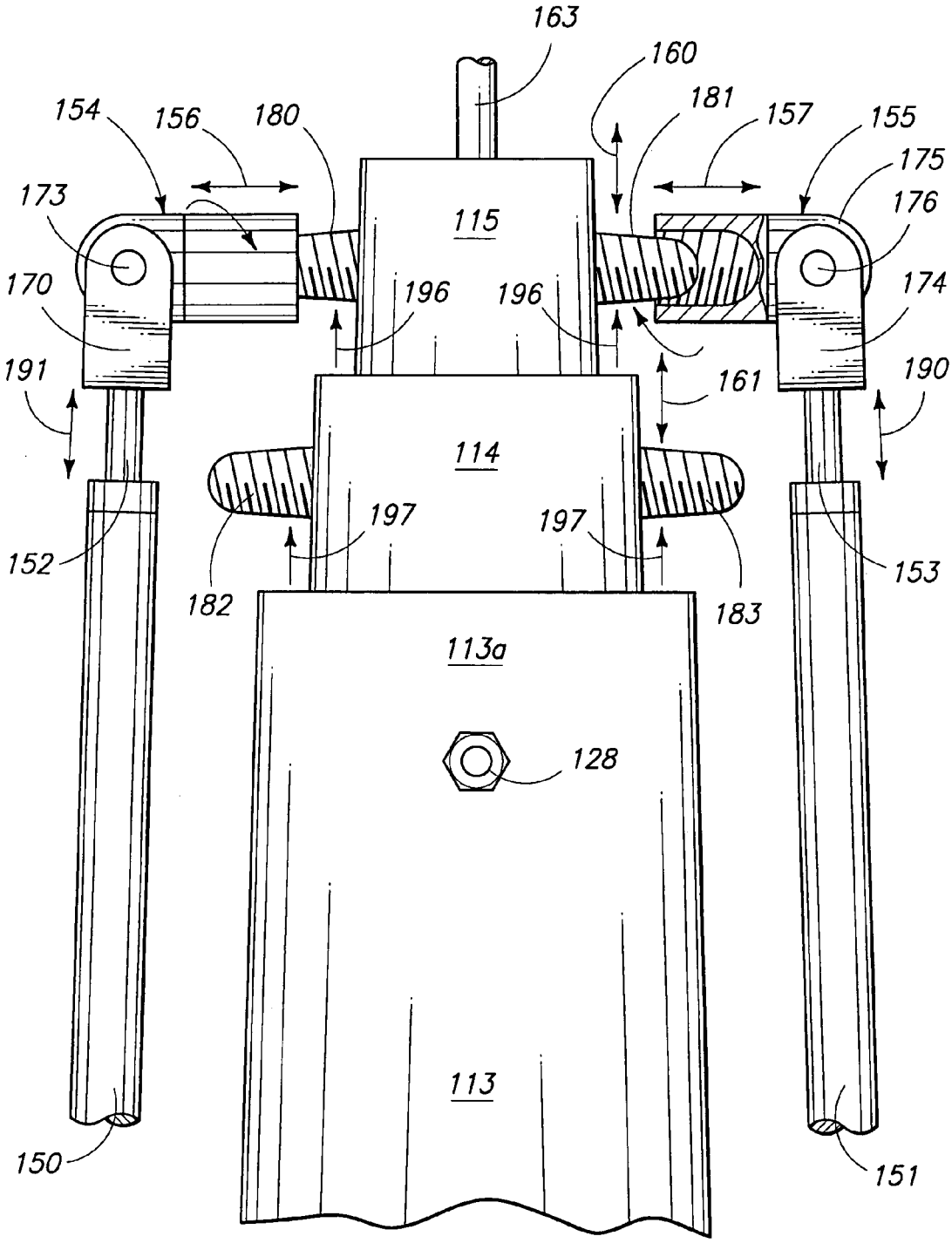
FIG. 5 is detail 5 from FIG. 4, illustrating the way in which the hydraulic lifters interconnect with the monopole tower structures in this one embodiment of the invention.

It will be appreciate by those of ordinary skill in the art, that any one of a number of different ways or mechanisms may be utilized to attach and detach the hydraulic rams 152 and 153 of hydraulic cylinders 150 and 151 respectively, to tower structures to sequentially raise them with respect to one another. FIG. 5, below, shows one way, the preferred way at the time of filing, to so secure, although others are contemplated within the scope of this invention.

FIG. 5 is detail 5 from FIG. 4, illustrating the way in which the hydraulic lifters interconnect with the monopole tower-structures in this one embodiment of the invention. FIG. 5 illustrates an; example of one embodiment which may be utilized to practice this invention for attaching and detaching the rams 152 and 153 of hydraulic cylinders 150 and 151 to the tower structures to raise them, detach from them, and raise the next one sequentially.

FIG. 5 illustrates first tower structure 113, second tower structure 114 and third tower structure 115, with arrows 197 illustrating relative movement between second tower structure 114 and first tower structure 113, and arrows 196 representing relative movement between third tower structure 115 and second tower structure 114. FIG. 5 shows first cone thread 180 and second cone thread 181 attached to third tower structure 115 and which provides a threaded mechanism for the attachment of first connector 154 and second connector 155 to third tower structure 115. First connector 154 and second connector 155 have internal threads and a cone shaped or reduced diameter thread on cone thread 180 and cone thread 181 provide a self-guiding or self-aligning mechanism, which makes connectors 154 and 155 more easily connected to cone threads 180 and 181. Arrows 156 and 157 show relative movement between first connector 154 and first cone thread 180 and between second connector 155 and second cone thread 181. The connectors would generally moved into place and then rotated to secure the connectors 154 and 155 to cone threads 180 and 181, respectively. Connectors are, but need not be, pivotally attached at points 173 and 176 to ram connectors 170 and 174. Ram connector 170 is attached to ram 152, and ram connector 174 is attached to ram 153.

Once third tower structure 115 is raised to its fully extended position relative to second tower structure 114, then the two can be secured relative to one another, and first connector 154 can be disconnected from cone thread 180 and second connector 155 can be disconnected from cone thread 181, and the connectors can then be attached to cone threads 182 and 183 to then facilitate the raising and relative movement of second tower structure 114 relative to first tower structure 113, as indicated by arrows 197. Once the second tower structure 114 is raised relative to first tower structure 113, it will be in its generally extended configuration for use. It will be appreciated by those of ordinary skill in the art that the first connector 154 and second connector 155 may be attached or operatively connected to the cone threads on any structure member in any one of a number of different ways, with no one in particular being required to practice this invention. In this case, the internally threaded portion of the first and second connectors 154 and 155 respectively, may be rotatably mounted and then rotated for instance by a hydraulic motor, with the rotation shown for example in FIG. 5.

The method of securing tower structures relative to one another and the mechanism for doing so is not limited to any one particular method as will be appreciated by those of ordinary skill in the art, but instead can be accomplished through multiple methods individually or accumulatively. For instance, the tolerances of the outer diameter of second tower structure 114 relative to the inner diameter of the top end 113A of first tower structure 113 is tight and snug such that there may be approximately three feet of snug fit and use of the rams to further force the tapered towers together can improve and provide a relatively snug fit for connectors to then be attached. The same would be true of the outer diameter of the bottom portion of third tower structure 115 relative to the inner diameter of second tower structure 114. The outer surfaces and diameters of the tower structures are tapered such that the bottom end of second tower structure 114 is larger than the inner diameter of the upper portion 113A of first tower structure 113 such that it cannot be removed therefrom through the top, but only securely positioned or tightened within the inner cavity of the tower structure which it fits within. This is further discussed below with respect to later drawings.

Figure 6:
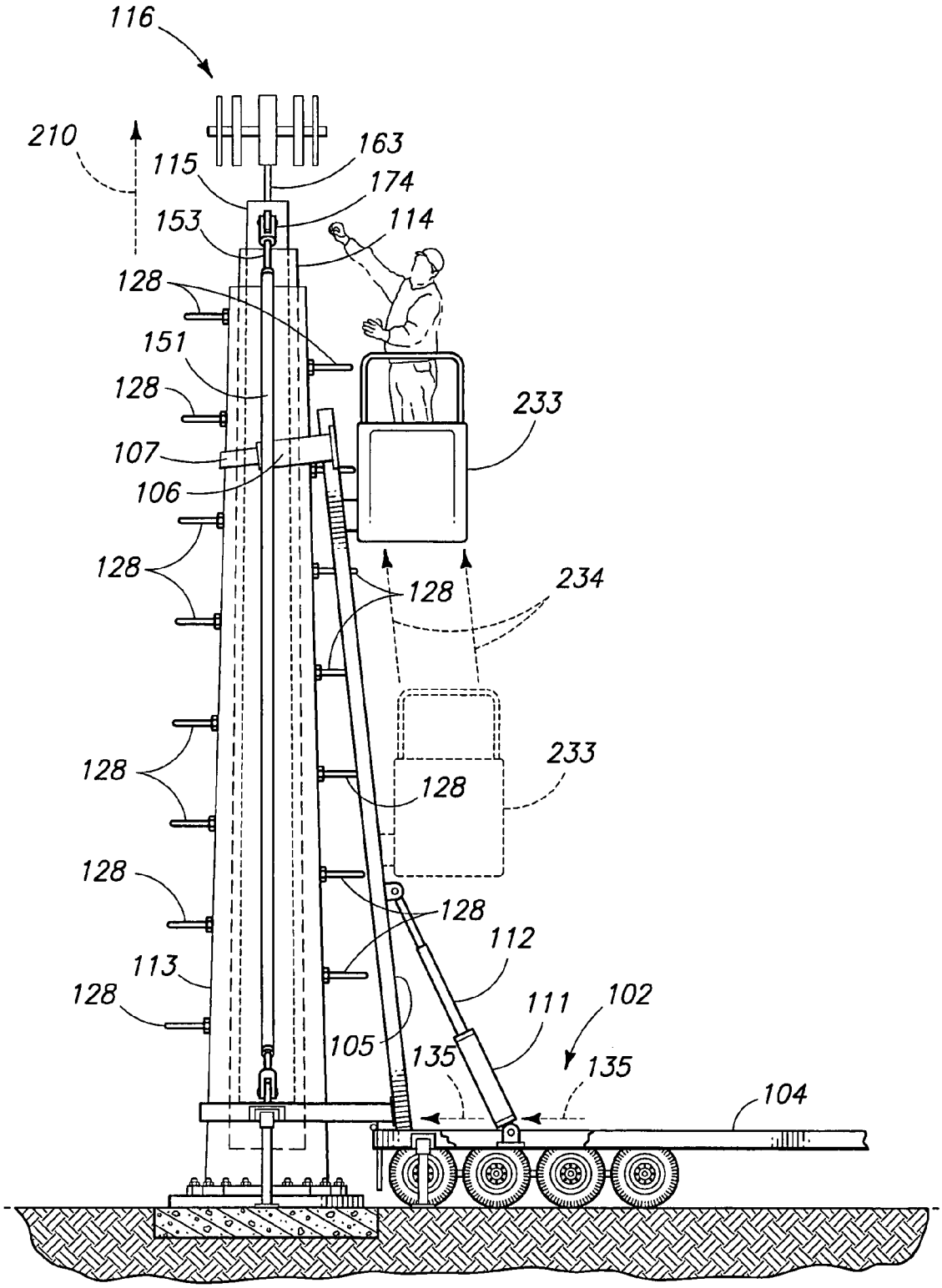
FIG. 6 is a front elevation view of the monopole tower system illustrated in FIG. 1, and further showing a platform which may be utilized in embodiments of this invention to provide a work platform to install antennas and other accessories.

FIG. 6 is a front elevation view of the monopole tower system 100 illustrated in FIG. 1, and further showing a platform which may be utilized in embodiments of this invention to provide a work platform to install antennas and other accessories. FIG. 6 illustrates first tower structure 113, second tower structure 114 and third tower structure 115, antenna 116 mounted to third tower structure 115. FIG. 6 is to illustrate how the antenna and other components can be installed or worked on during this stage of the erection process where the tower is vertical and attached but still in its fully contracted position. There are different alternatives which may be used individually or cumulatively at different times to allow workers or operators to get up to the top of the contracted tower to do the work. For instance, foot pegs 128 may be provided on the outside of the tower to allow workers to manually climb up the tower, and these foot pegs 128 may be provided on all three tower structures, namely the first tower structure 113, second tower structure 114 and third tower structure 115. Alternatively, an operator platform 233 may be movably mounted to monopole support framework 105 to allow a worker to have a platform on which to stand while they do work. The platform may be movably mounted to raise the worker to a higher level and then lowered. The platform 233 may also be attached while the tower is being transported to the location, or it may be attached at an interim raise point such as that shown on FIG. 2 or FIG. 3. Arrows 234 illustrate the relative movement of platform 233 with respect to monopole support framework 105.

FIG. 6 further illustrates hydraulic cylinder 151, ram 153, hydraulic cylinder 111, and movement arrows 135 for the relative movement of the hydraulic cylinder 111 relative to the trailer framework 104.

Figure 7:
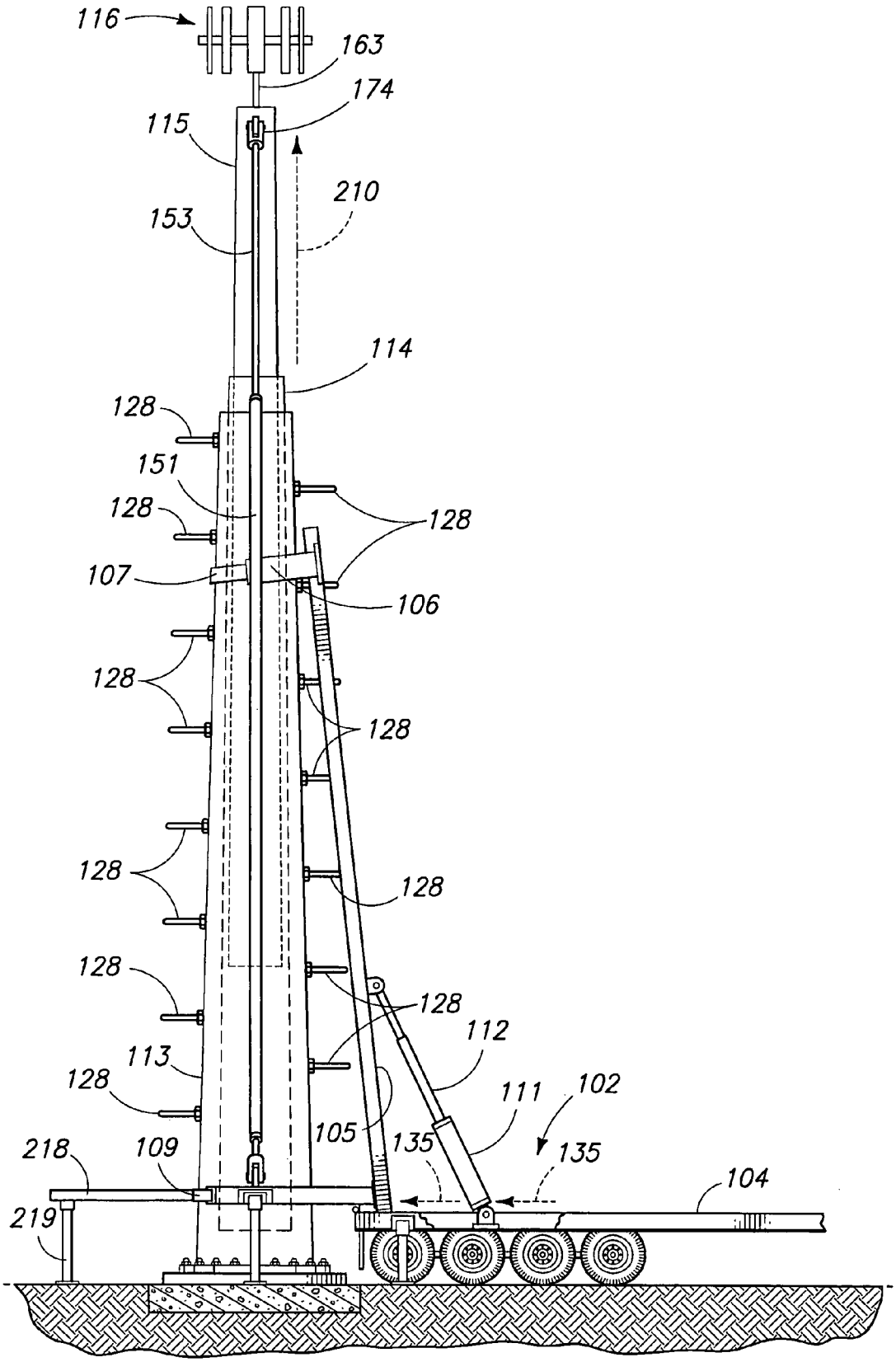
FIG. 7 is a front elevation view of the embodiment of this invention illustrated in FIG. 1, showing the third monopole tower structure being lifted by the hydraulic lifter.

FIG. 7 is a front elevation view of the embodiment of this invention illustrated in FIG. 1, showing the third monopole tower structure being lifted by the hydraulic lifter. FIG. 7 illustrates first tower structure 113, second tower structure 114 and third tower structure 115 during the initial movement of third tower structure 115 relative to second tower structure 114 by hydraulic cylinder 151 pushing ram 153 vertically. The arrow 210 shows the relative movement of third tower structure 115. FIG. 7 further shows outrigger 218, ground support 219, lower cradle 108, hydraulic cylinder 111 and trailer framework 104. The monopole support framework 105 is shown with upper cradle 106 still attached to first tower structure 113 by cradle strap 107.

Figure 8:
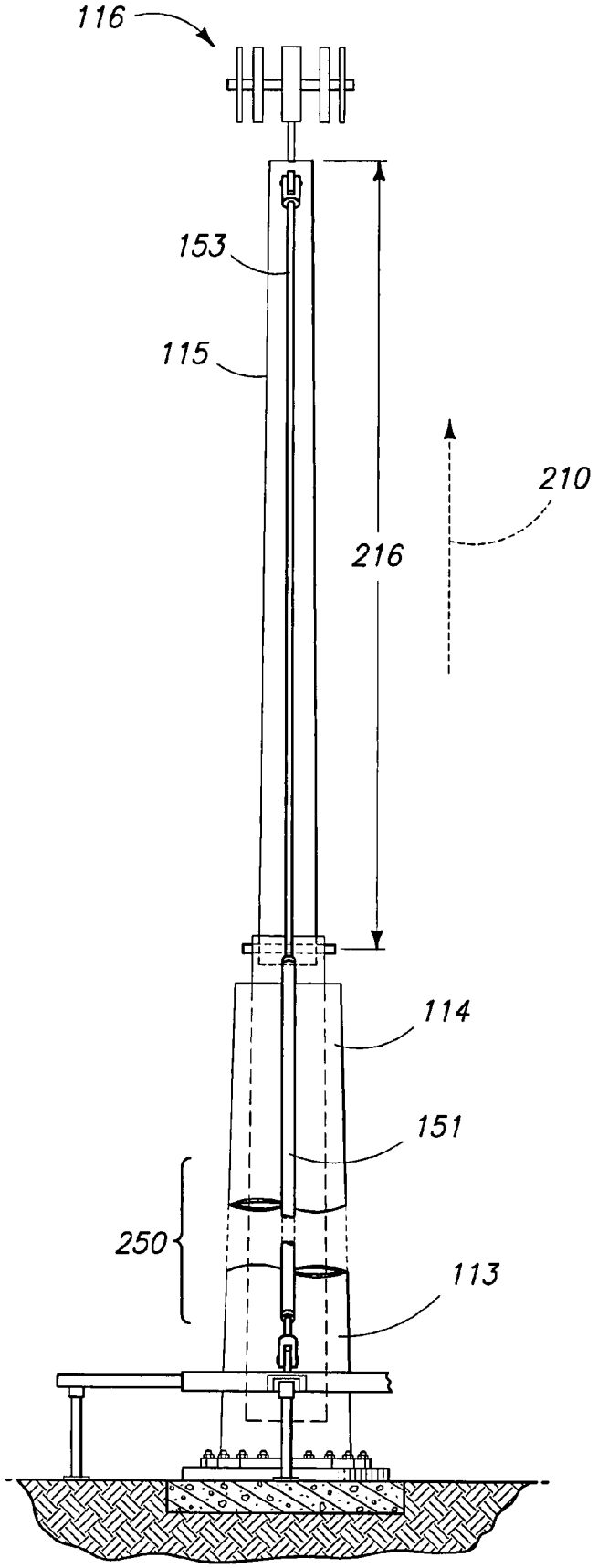
FIG. 8 is a partial front elevation view of the monopole tower system illustrated in FIG. 1, showing the third monopole tower structure in its fully extended position relative to the second monopole tower structure.

FIG. 8 is a partial front elevation view of the monopole tower system 100 illustrated in FIG. 1, showing the third monopole tower structure 115 in its fully extended position relative to the second monopole tower structure 114. FIG. 8 illustrates when third tower structure 115 has been extended to its full length 216 relative to second tower structure 114, the movement indicated by arrow 210. Hydraulic cylinder 151 has extended ram 153 to achieve the full extension and the securement of third tower structure 115 relative to second tower structure 114 can now be accomplished by an operator. Once there is securement of third tower structure 115 relative to second tower structure 114, the ram 153 can be disconnected from third tower structure 115, lowered and then reattached to second tower structure 114 with the same process being followed. FIG. 8 is a broken view shown by section 250 which results in it being disproportionate but is used for illustrative purposes to show the full extension of third tower structure 115 relative to second tower structure 114, with the break occurring in first tower structure 113.

Figure 9:
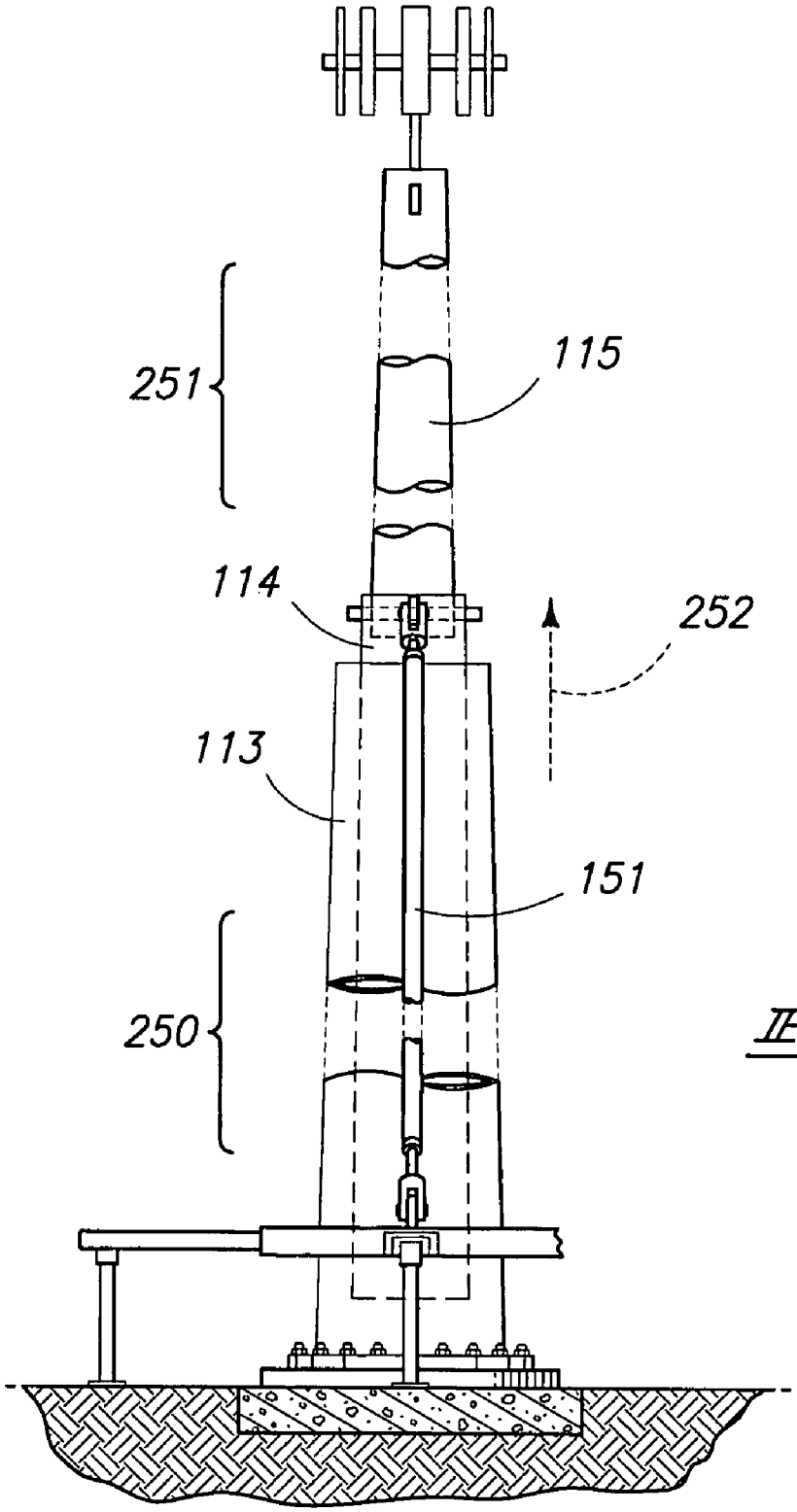
FIG. 9 is a partial front elevation view of the monopole tower system illustrated in FIG. 1, and showing the hydraulic lifter attached to the second monopole tower structure just prior to raising it relative to the first monopole tower structure.

FIG. 9 is a partial front elevation view of the monopole tower system illustrated in FIG. 1, and showing the hydraulic lifter attached to the second monopole tower structure 114 just prior to raising it relative to the first monopole tower structure 113. FIG. 9 is another broken elevation view showing third tower structure 115 broken as indicated at section 251 and first tower structure 113 broken at section 250 for illustrative purposes to show that it is second tower structure 114 being raised relative to first tower structure 113 as shown by arrow 252 and being raised by hydraulic cylinder 151. This would be the second raising of a tower structure relative to another and in this embodiment of the invention where there are only three tower structures, the final raising of a tower structure.

It will be appreciated by those of ordinary skill in the art, that while a tower configuration with three sections or three structures is shown in this embodiment, this invention is certainly not limited to three structures and it can provide two structures or more, a plurality, in accomplishing the invention.

Figure 10:
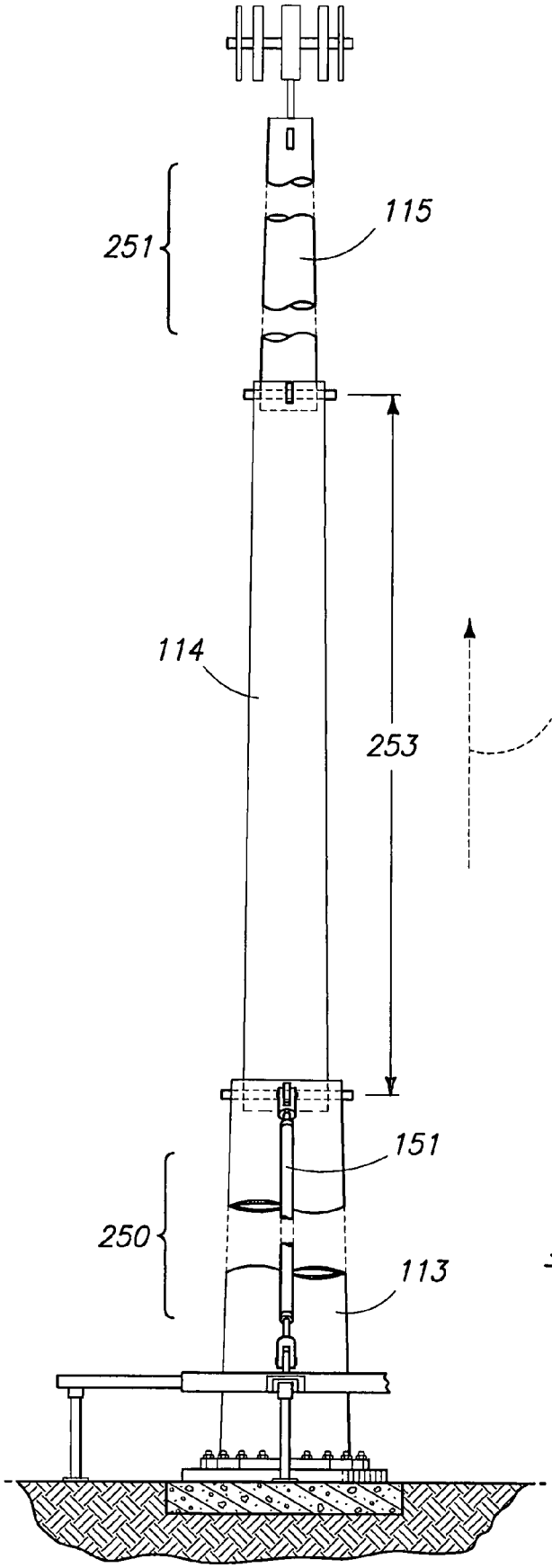
FIG. 10 is a partial front elevation view of the monopole tower system illustrated in FIG. 1, and showing the second monopole tower structure in its fully extended position.

FIG. 10 is a partial front elevation view of the monopole tower system illustrated in FIG. 1, and showing the second monopole tower structure 114 in its fully extended position. FIG. 10 shows another broken view at section 251 where third tower structure 115 is shown in broken view and first tower structure 113 is shown in a broken view at sections 250 and 251, with second tower structure 114 being in the fully extended and secured position at length 253. Arrow 252 shows the direction that it was moved and hydraulic cylinder 151 has been lowered out of the way. It is in this position that second tower structure 114 can be secured and operatively attached relative to first tower structure 113, thereby completing the raising and erection of the monopole tower to its intended height. From this point, the hydraulic cylinder 151 and 152 (shown in prior figures) can be detached from the monopole completely and the monopole support framework 105 detached so that the monopole tower system 100 may be removed from the monopole tower as it stands freely.

Figure 11:
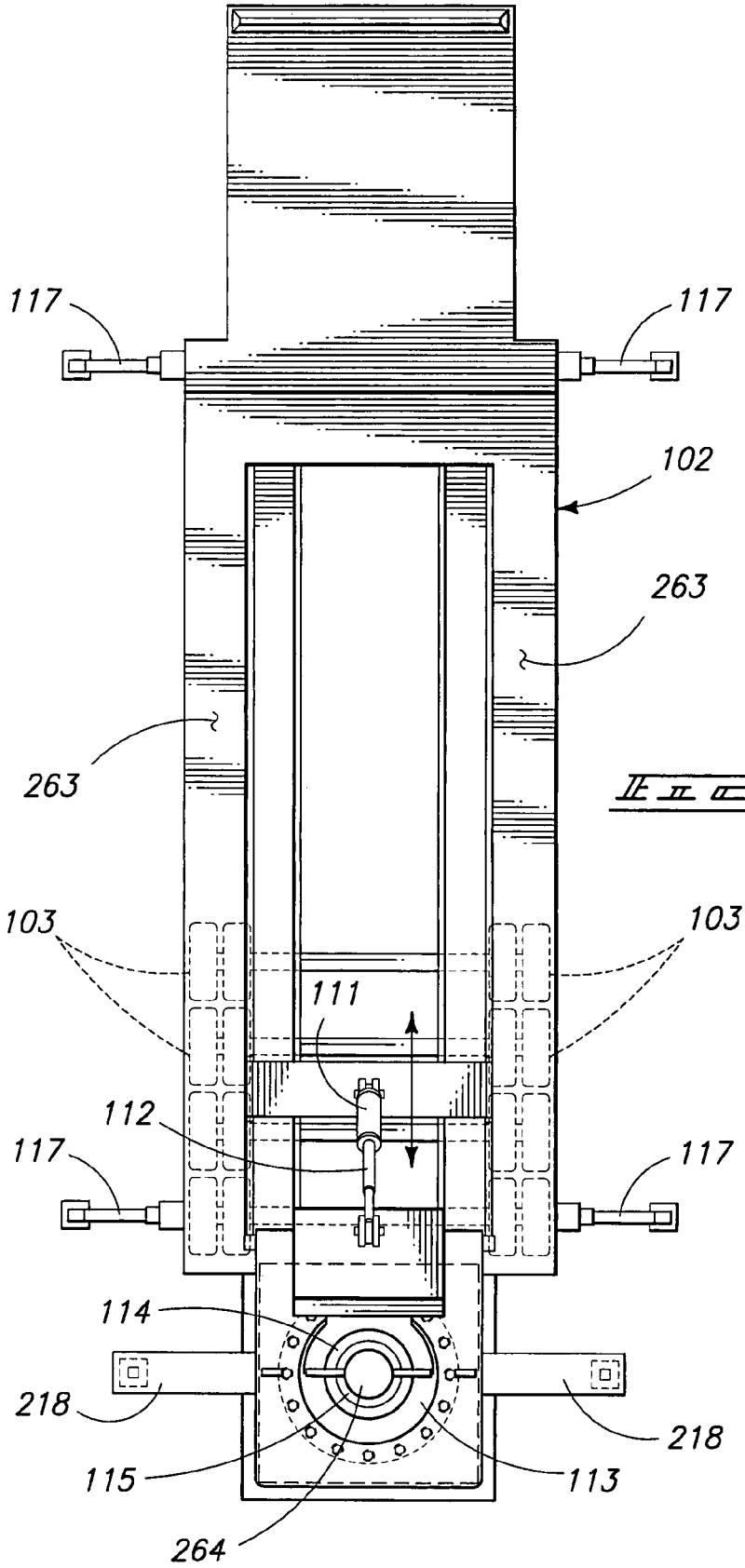
FIG. 11 is a top view of the monopole tower system illustrated in FIG. 1, and in which the tower is in the vertical position.

FIG. 11 is a top view of the monopole tower system illustrated in FIG. 1, and in which the tower is in the vertical position. FIG. 11 illustrates outriggers 117 fully extended providing support to trailer 102, trailer platform or decking 263, trailer wheels 103 and still positioned relative to the monopole just before it is removed. The monopole is in its vertical position and first tower structure 113, second tower structure 114 and third tower structure 115 are shown respectively with internal cavity 264 being also shown. Outriggers 218 are also shown.

Figure 12:
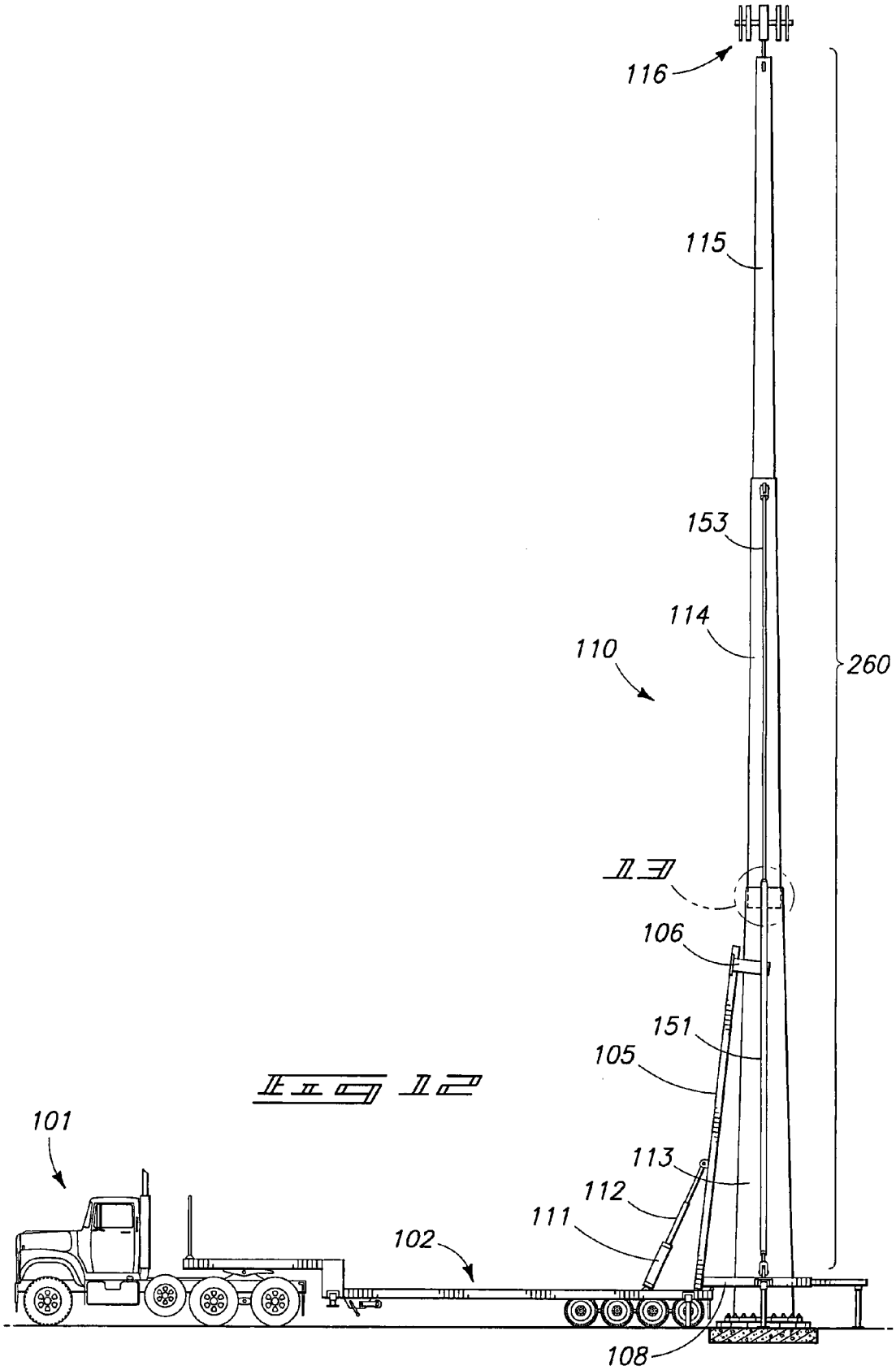
FIG. 12 is a front elevation view of the monopole tower system illustrated in FIG. 1 in its fully extended and secured position just prior to removing the system equipment.

FIG. 12 is a front elevation view of the monopole tower system 100 illustrated in FIG. 1 in its fully extended and secured position just prior to removing the system equipment. FIG. 12 shows the monopole tower 110 in its fully extended and installed position at approximate height 260, showing first tower structure 113, second tower structure 114 and third tower structure 115 all secured relative to one another. FIG. 12 shows the complete monopole tower 110 at its fully extended height with hydraulic ram 153 still attached to the top of second tower structure 114 after it has just been raised. The detail shown between and around the overlap or connection between first tower structure 113 and second tower structure 114 is more fully illustrated in an exemplary way in the description relative to FIG. 13 below. Monopole support framework 105 is shown with upper cradle 106 and lower cradle 108, with vehicle 101 attached to trailer 102.

Figure 13:
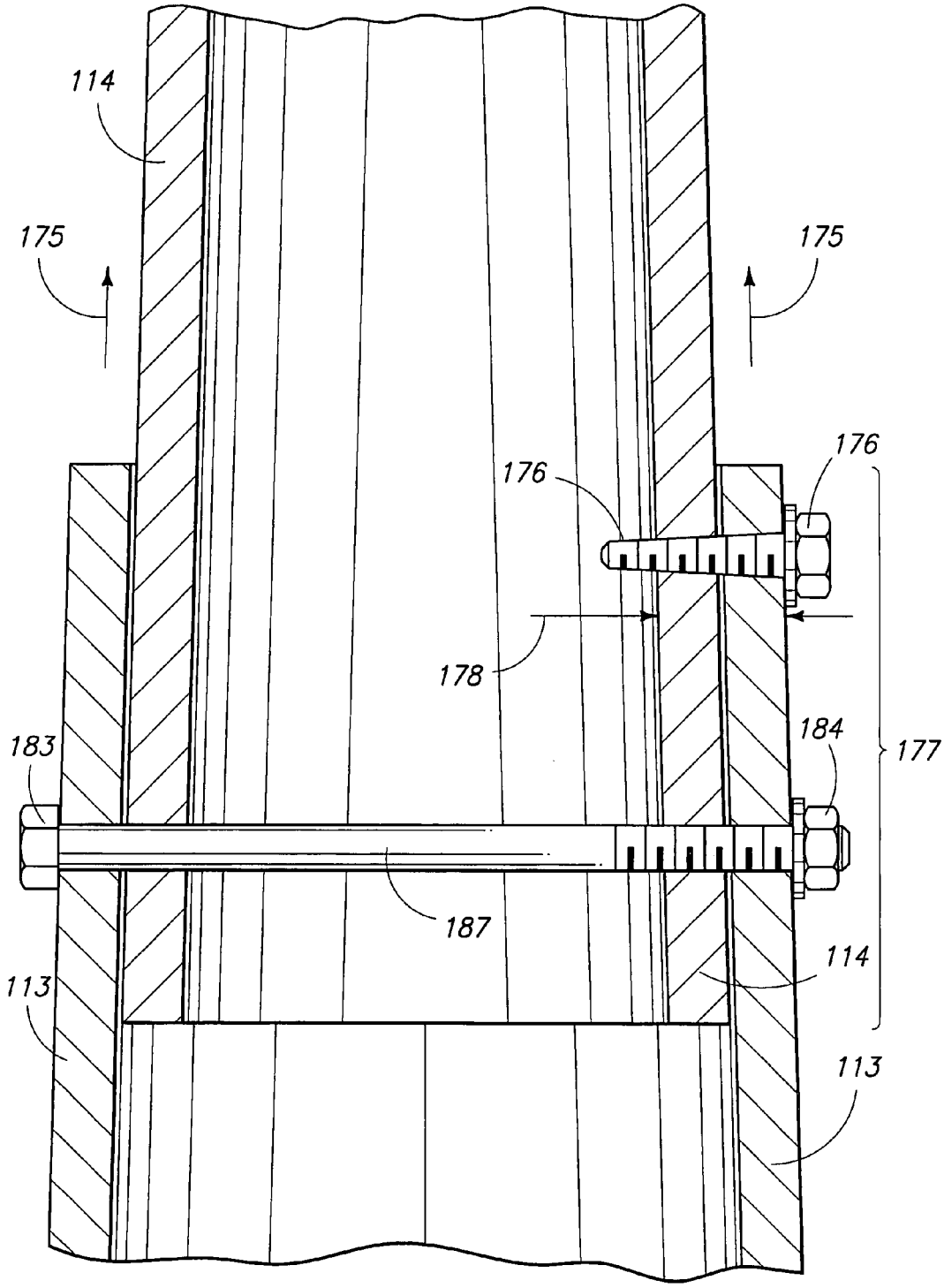
FIG. 13 is detail 13 from FIG. 12, and illustrates one embodiment or example of how one monopole tower structure would be attached or fixed relative to another and adjacent monopole tower structure during normal usage of the monopole tower.

FIG. 13 is detail 13 from FIG. 12, and illustrates one embodiment or example of how one monopole tower structure would be attached or fixed relative to another and adjacent monopole tower structure during normal usage of the monopole tower. FIG. 13 is a cross section elevation view of one example of an embodiment showing alternative ways to connect or secure the tower structures to one another, with the example being the securement of first tower structure 113 to second tower structure 114. As shown in FIG. 13, there is some distance 177 at which there is a snug fit between first tower structure 113 and second tower structure 114, which provides snugness and stability with attaching devices or fastening devices then being utilized to further secure the relative movement and to tighten the connection between the respective tower structures. FIG. 13 shows one example as a bolt or rod 187 protruding through apertures in both first tower structure 113 and second tower structure 114 on both sides, with a nut 184 screwed thereon to provide vertical securement and to better hold first tower structure 113 tight relative to second tower structure 114. Another fastening mechanism may be a self tapping type screw (on a larger scale) which goes through both first tower structure 113 and second tower structure 114, the screw having a self tapping thread and pulling the first tower structure 113 relative to the second tower structure 114 as indicated by arrows 178. Arrows 175 illustrate how second tower structure 114 may be pushed upwardly by the hydraulic ram (not shown in FIG. 13) which due to the relative taper and sizing of the second tower structure 114 relative to the internal cavity of first tower structure 113 to provide a snug fit and some alignment. The approximate distance 177 of the overlap may be determined based upon the application, but in 150 foot pole span, a three foot or more snug fit area may be provided for securement.

FIG. 14 is a partially schematic end view illustrating alignment issues requiring rotation of the monopole as it is being lowered to be secured to the base, with the bolt apertures needing to be lined up with the bolts protruding from the base. FIG. 14 schematically illustrates a problem which will naturally be incurred in installing these monopoles due to the desire to have protruding screws 224 from base pad 130 and needing to match the screws to a pattern of screw apertures 223 in monopole base 127. Once the monopole is delivered to the site and is beginning to be lowered, it will need to be rotated as shown by arrow 228 to properly align the bolts 224 with the bolt apertures 223. Line 226 relative to tower base 127 shows the location of a bolt aperture whereas the corresponding bolt that will need to protrude through the aperture is indicated by line 225 with angle 227 there between. The monopole tower 110 will therefore have to be rotated by angle 227 to result in a matching of the bolts 224 with the bolt apertures 223.

It will be appreciated by those of ordinary skill in the art that the rotation and alignment of the bolt apertures 223 on tower base 127 with bolts 224 protruding from base pad 130 can be accomplished in any one of a number of different ways within the contemplation of this invention, with no one way being required to practice this invention. FIG. 15 shows one of the mechanisms to accomplish this.

FIG. 15 is a cross-sectional end view of the first cradle and illustrates one embodiment of how the monopole might be rotated in order to align the bolt apertures in the monopole base with the bolts protruding from the support base. FIG. 15 illustrates lower cradle 108 with rollers 257 on either side of the center of the cradle and drive roller 191 in the bottom center. Drive roller 191 can provide the drive to rotate first tower structure 113 to align bolt apertures 223. Drive roller 192 is shown rotating by direction arrow 192 to cause the rotation indicated by arrow 195 of tower base 127. Rotation drive 193 may be a motor or hydraulic drive and intermediate roller 194 or gear may be utilized to provide the rotation necessary for drive roller 191 to cause the desired angular rotation, such as angle 227 shown in FIG. 14.

If this drive mechanism is utilized it will be unlikely necessary for a drive roller to be needed at the upper cradle, but instead the upper cradle can just be provided with a surface or rollers to better facilitate not completely resist the rotation of the tower system relative to the cradles and to provide the appropriate alignment so that the bolts protruding from the base pad can protrude through the bolt apertures in tower base 127.

FIG. 15 is a cross-sectional end view of the first cradle and illustrates one embodiment of how the monopole might be rotated in order to align the bolt apertures in the monopole base with the bolts protruding from the support;

FIG. 16 is a front elevation partial view of the monopole tower system illustrated in FIG. 1, only wherein the monopole system 100 is configured with an adapter 300 to connect to other vehicles and equipment. The other items in FIG. 16 are the same items and identifications as set forth with respect to FIG. 2 and will not therefore be repeated here.

FIG. 17 is a front elevation partial view of the monopole tower system 100 illustrated in FIG. 16, wherein the monopole system adapter 300 is configured to operatively connect to an excavator 301. The other items in FIG. 17 are the same items and identifications as set forth with respect to FIG. 2 and will not therefore be repeated here.

Figure 18:
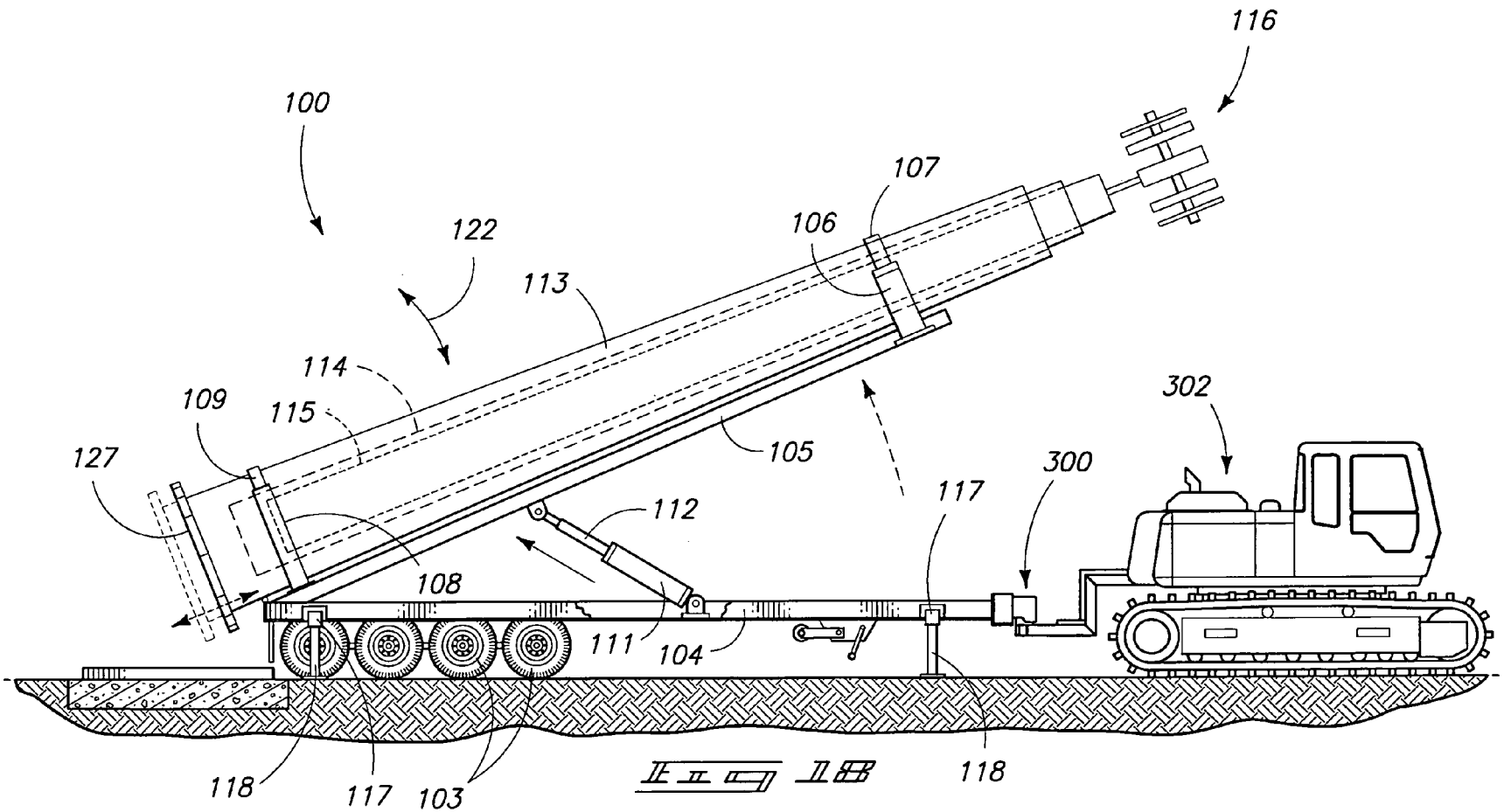
FIG. 18 is a front elevation partial view of the monopole tower system illustrated in FIG. 16, wherein the monopole system adapter is configured to operatively connected to a cat type of vehicle.
Figure 11:
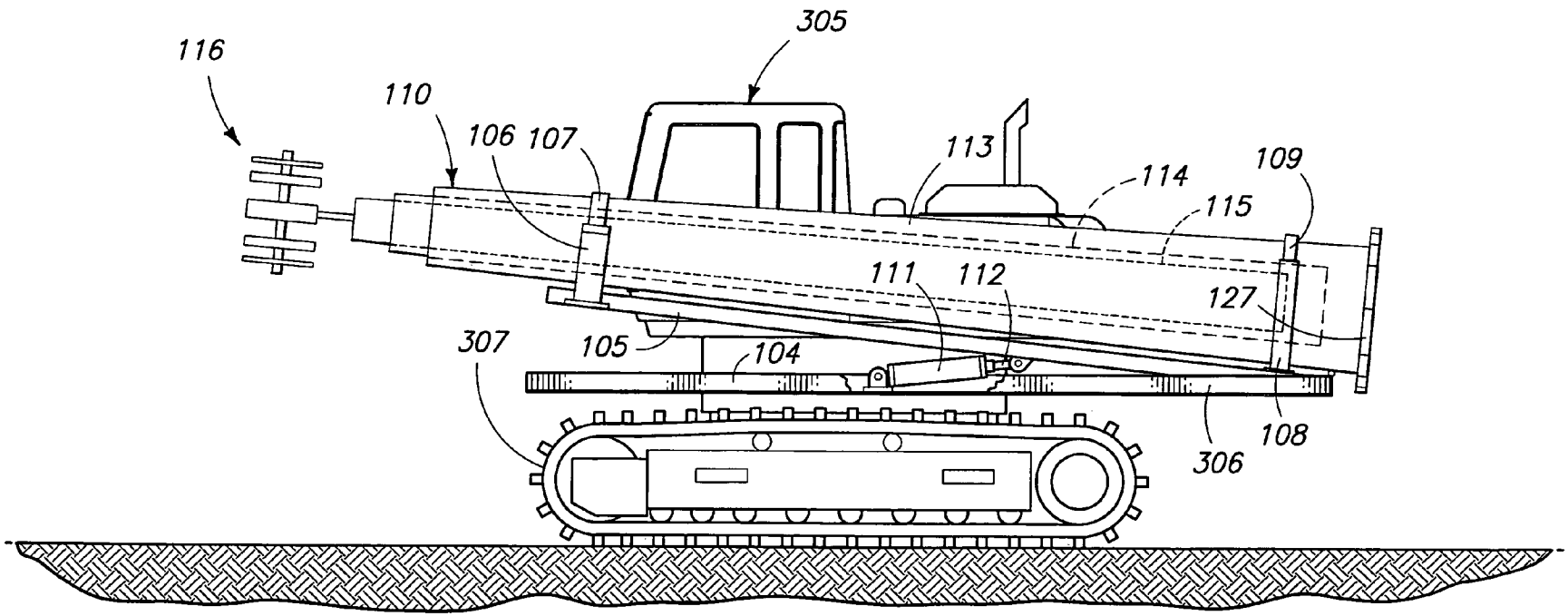

FIG. 18 is a front elevation partial view of the monopole tower system 100 illustrated in FIG. 16, wherein the monopole system adapter 300 is configured to operatively connected to a cat 302 type of vehicle. The other items in FIG. 18 are the same items and identifications as set forth with respect to FIG. 2 and will not therefore be repeated here.

FIG. 19 is a front elevation partial view of the monopole tower system 100 illustrated in FIG. 16, wherein the monopole system adapter 300 is configured to operatively connect to a log loader type of vehicle. The other items in FIG. 19 are the same items and identifications as set forth with respect to FIG. 2 and will not therefore be repeated here. The log loader embodiment or application has particular advantages when installing poles of any type in difficult terrain, and may additionally provide a log or pole loader arm to load logs onto the cradles.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

The invention claimed is:

1. A monopole tower system comprising:

a monopole first tower structure with a top end, a bottom end, a top portion and a bottom portion and an internal cavity, wherein an inner surface of the top portion of the first tower structure is at least partly tapered;

a monopole second tower structure with a top end, a bottom end, top portion and a bottom portion, wherein an outer surface of the bottom portion of the second tower structure is at least partly tapered corresponding to the inner surface of the top portion of the first tower structure;

wherein the bottom end of the second tower structure is larger than the internal cavity at the top end of the first tower structure; and wherein the outer surface of the bottom portion of the second tower structure is disposed within the inner surface of the top portion of the first tower structure with at least one lock securing the top portion of the first tower structure to the bottom portion of the second tower structure; and further wherein the at least one lock securing the top portion of the first tower structure to the bottom portion of the second tower structure is locked into place while the first tower structure is in a vertical orientation.

2. A monopole tower system as recited in claim 1, and further wherein the monopole second tower structure includes an internal cavity and includes an inner surface of the top portion of the second tower structure being at least partly tapered;

a monopole third tower structure with a top portion and a bottom portion, wherein an outer surface of the bottom portion of the third tower structure is at least partly tapered corresponding to the inner surface of the top portion of the second tower structure;

wherein the bottom end of the third tower structure is larger than the internal cavity at the top end of the second tower structure; and wherein the outer surface of the bottom portion of the third tower structure is disposed within the inner surface of the top portion of the second tower structure with at least one lock securing the top portion of the second tower structure to the bottom portion of the third tower structure.

3. A monopole tower system as recited in claim 1, and further wherein the lock is a fastener.

4. A monopole tower erection system for erecting a monopole tower with a first tower structure with an internal cavity and a second tower structure which may be disposed within the internal cavity, the monopole tower erection system comprising:

a base framework with a front end and a rear end;

a monopole support framework disposed to retain a monopole tower structure, the monopole support framework being movably mounted to the base framework such that it may be moved from a travel position to an erected position which is substantially vertical;

a hydraulic cylinder operatively attached to both the base framework and the monopole support structure, and configured to provide a force necessary to move the monopole support framework from the travel position to the erected position;

two erector hydraulic cylinders operably attached at a first end to one of the base framework and the monopole support structure, and each hydraulic cylinder including an adapter at a second end which is attachable to and detachable from the second tower structure, and with an extension length sufficient to raise a lower portion of the second tower structure relative to an upper portion of the first tower system.

5. A monopole tower erection system as recited in claim 4, and further comprising:

wheels rotatably attached to the base framework such that the base framework becomes a mobile trailer system; and an adapter attached to the base framework, the adapter configured to operably connect to a vehicle for towing the tower erection system.

6. A monopole tower erection system as recited in claim 4, and further wherein the base framework is integral with a vehicle.

7. A method of erecting a monopole tower structure, comprising:

providing a tower lift framework providing a monopole first tower structure in a vertical position with a top end, a bottom end, a top portion and a bottom portion and an internal cavity, wherein an inner surface of the top portion of the first tower structure is at least partly tapered;

providing a monopole second tower structure with a top end, a bottom end, a top portion with a lift adapter, and a bottom portion, wherein an outer surface of the bottom portion of the second tower structure is at least partly tapered corresponding to the inner surface of the top portion of the first tower structure, and further wherein the bottom end of the second tower structure is larger than the internal cavity at the top end of the first tower structure and the second tower structure is located within the internal cavity of the first tower structure; and wherein the outer surface of the bottom portion of the second tower structure is disposed within the inner surface of the top portion of the first tower structure with at least one lock securing the top portion of the first tower structure to the bottom portion of the second tower structure.

8. A method of erecting a monopole tower structure comprising:

providing a tower lift framework;

providing a first tower structure and a second tower structure of a monopole tower structure in a vertical orientation, with the second tower structure being substantially nested within an internal cavity of the first tower structure;

providing at least two hydraulic cylinders operably attached at a first end to the tower lift framework, the hydraulic cylinders with rams being disposed to operably attach and detach to a protruding top end of the second tower structure;

operably attaching the at least two hydraulic cylinders to the protruding top end of the second tower structure;

extending the rams of the at least two hydraulic cylinders to move the second tower structure substantially out of the first tower structure;

securing a top portion of the first tower structure to a bottom portion of the second tower structure; and disconnecting the at least two hydraulic cylinders from the second tower structure and retracting the rams of the at least two hydraulic cylinders.

9. A method of erecting a monopole tower structure as recited in claim 8, and further wherein the tower structure adapters are attachable and detachable directly to the second tower structure.

10. A method of erecting a monopole tower structure comprising:

providing a tower lift framework;

providing a first tower structure in a vertical orientation, a second tower structure and a third tower structure of a monopole tower structure, with the second tower structure being substantially nested within an internal cavity of the first tower structure and the third tower structure being substantially nested within an internal cavity of the second tower structure;

providing at least two hydraulic cylinders operably attached at a first end to the tower lift framework, the hydraulic cylinders with rams being disposed to operably attach and detach to a protruding top end of the second tower structure or the third tower structure;

operably attaching the at least two hydraulic cylinders to the protruding top end of the third tower structure extending the rams of the at least two hydraulic cylinders to move the third tower structure substantially out of the internal cavity of the second tower structure;

securing a top portion of the second tower structure to a bottom portion of the third tower structure;

disconnecting the at least two hydraulic cylinders from the third tower structure and retracting the rams of the at least two hydraulic cylinders;

operably attaching the at least two hydraulic cylinders to the protruding top end of the second tower structure;

extending the rams of the at least two hydraulic cylinders to move the second tower structure substantially out of the internal cavity of the first tower structure;

securing a top portion of the first tower structure to a bottom portion. of the second tower structure; and disconnecting the at least two hydraulic cylinders from the second tower structure and retracting the rams of the at least two hydraulic cylinders.

11. A method of erecting a monopole tower structure as recited in claim 10, and further wherein the tower structure adapters are attachable and detachable directly to the second tower structure and the third tower structure.

* * * * *